US008056463B2

(12) United States Patent
Grove et al.

(10) Patent No.: US 8,056,463 B2
(45) Date of Patent: Nov. 15, 2011

(54) VEHICLE WINDOW COVER

(75) Inventors: Lee A. Grove, Mishawaka, IN (US); Donald F. Rhoad, Bamberg, SC (US)

(73) Assignee: Defense Consulting Services, Inc., Bamberg, SC (US)

( * ) Notice: Subject to any disclaimer, the term of this patent is extended or adjusted under 35 U.S.C. 154(b) by 1165 days.

(21) Appl. No.: 11/757,863

(22) Filed: Jun. 4, 2007

(65) Prior Publication Data

US 2011/0209606 A1 Sep. 1, 2011

Related U.S. Application Data

(63) Continuation-in-part of application No. 11/333,783, filed on Jan. 17, 2006, now Pat. No. 7,225,718.

(60) Provisional application No. 60/644,116, filed on Jan. 14, 2005.

(51) Int. Cl.
*F41H 5/14* (2006.01)

(52) U.S. Cl. ..... 89/36.09; 89/36.01; 89/36.08; 89/929; 89/930

(58) Field of Classification Search ..... 89/36.01, 89/36.04, 36.07–36.09, 36.11–36.14
See application file for complete search history.

(56) References Cited

U.S. PATENT DOCUMENTS

| | | | | |
|---|---|---|---|---|
| 3,658,631 | A * | 4/1972 | Shaw et al. | 428/415 |
| 3,672,607 | A | 6/1972 | Stauff et al. | |
| 4,005,662 | A * | 2/1977 | Kohn et al. | 109/16 |
| 4,326,445 | A | 4/1982 | Bemiss | |
| 4,934,246 | A | 6/1990 | Benson et al. | |
| 5,128,803 | A | 7/1992 | Sprafke | |
| 5,315,915 | A | 5/1994 | Sprafke | |
| 5,452,641 | A | 9/1995 | Kariya | |
| 5,554,816 | A * | 9/1996 | Skaggs et al. | 89/36.17 |
| 5,749,140 | A | 5/1998 | Polito et al. | |
| 6,187,451 | B1 | 2/2001 | Boos | |
| 2004/0016058 | A1 | 1/2004 | Gardiner et al. | |
| 2009/0044694 | A1 * | 2/2009 | Allor et al. | 89/36.08 |

FOREIGN PATENT DOCUMENTS

| | | |
|---|---|---|
| EP | 1 767 443 A1 | 3/2007 |
| GB | 2 223 325 A | 4/1990 |

* cited by examiner

*Primary Examiner* — Gabriel Klein
(74) *Attorney, Agent, or Firm* — Botkin & Hall, LLP

(57) ABSTRACT

A window cover for a military vehicle which includes both upper and lower armored plates angled away from an underlying vehicle window. An upper and lower reflector are placed so that light striking the upper reflector is reflected onto the lower reflector. One of the reflectors is pivotable. The window cover allows an occupant of the vehicle to view outside the vehicle window, as light is reflected off an upper reflector to a lower reflector and toward an occupant of the vehicle. A filter is placed between the upper and lower reflectors to filter out a portion of light reflected. The filter may also provide a collimation function.

10 Claims, 3 Drawing Sheets

VEHICLE WINDOW COVER

CROSS REFERENCE TO RELATED APPLICATIONS

This application is a continuation in part of application Ser. No. 11/333,783 filed Jan. 17, 2006 now U.S. Pat. No. 7,225,718, allowed Jan. 29, 2007 which claims priority and benefit of provisional Application No. 60/644,116 filed Jan. 14, 2005, the disclosures of which are hereby incorporated by reference.

BACKGROUND OF THE INVENTION

Field of the Invention

U.S. patent application Ser. No. 11/333,783 discloses a device for using reflectors to see out of a military vehicle window. The device uses an upper armored plate with reflective covering disposed on its underside. A lower reflector is placed below the upper plate and ahead of a lower armored plate. This configuration enables an occupant of the vehicle to see out windows of a military vehicle and remain protected from projectiles fired at the vehicle. While successful, the field of view as seen by the occupant of a vehicle is not adjustable because the reflectors are fixed in place. Also, light striking the lower reflector is redirected toward a vehicle occupant's eyes without being filtered.

SUMMARY OF THE INVENTION

The present invention is an improvement for a window cover used for viewing out of a window. The window cover has a lower armored plate that has an outer side and an inner side angled away from an underlying window. The inner side is located adjacent and in front of the window and a lower reflector overlies the inner side of the lower armored plate. An upper reflector angled is angled away from the underlying window and positioned at least partially above the lower reflector and in front of another armored plate. The upper reflector is penetrable by projectiles fired at the vehicle toward the window. One of the reflectors is pivotable.

A filter for light is placed between the upper and lower reflectors. The filter filters out portions of light passing through it and may also include a collimator.

An object of the invention is to provide a window cover that has an adjustable field of view.

Another object of the invention is to provide a field of view similar to that of a traditional window.

Another object of the invention is to provide a filter for light that passes through a window cover for a vehicle.

Still other objects of the invention will become apparent upon reading the following description.

DETAILED DESCRIPTION OF INVENTION

Figure 1:
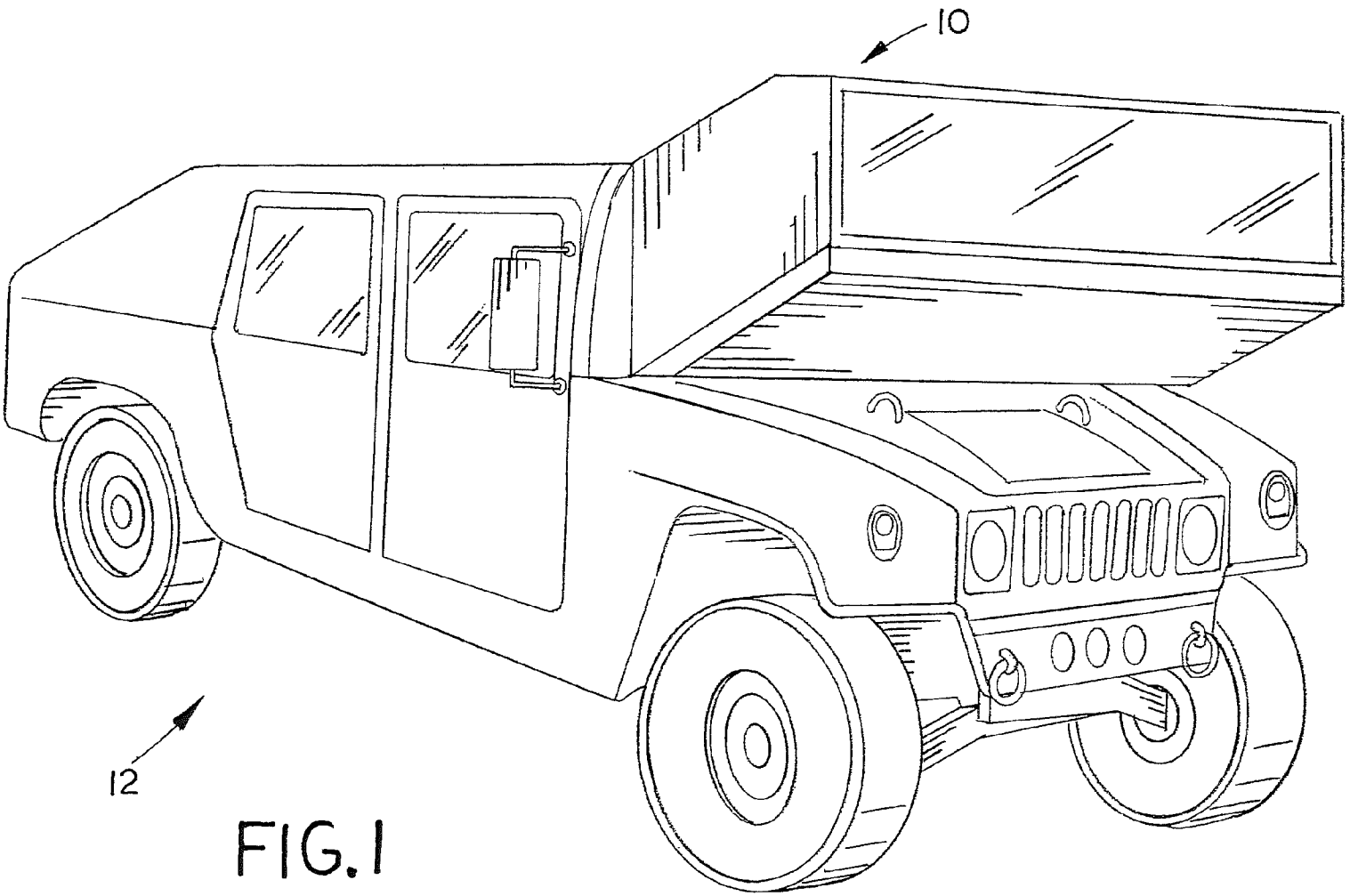
FIG. 1 is a perspective view of the window cover of this invention.
Figure 2:
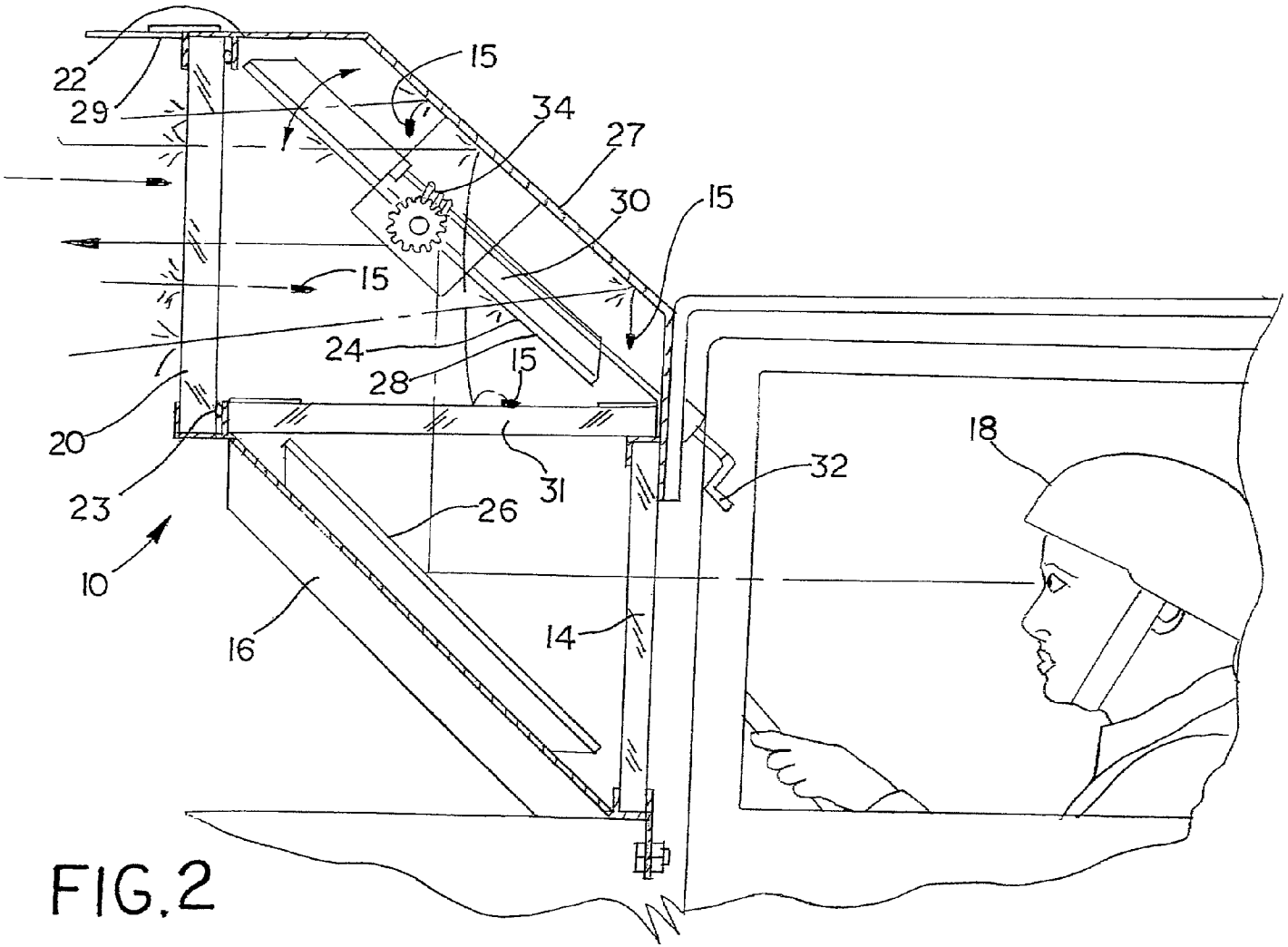
FIG. 2 is section view of the window cover.

A window cover 10 shown in FIG. 1 is attached to a military vehicle 12, which is preferably a military vehicle. The window cover 10 is used over a window 14, as shown in FIG. 1, of vehicle 12. The window cover 10 is removably mounted in place on the vehicle by suitable fasteners. As seen in FIG. 2, an occupant 18 of the military vehicle 12 is able to utilize the window cover 10 to have an unobstructed view through the vehicle window 14 with protection from bullets 15 or similar projectiles fires at the window and the vehicle occupant.

Figure 3:
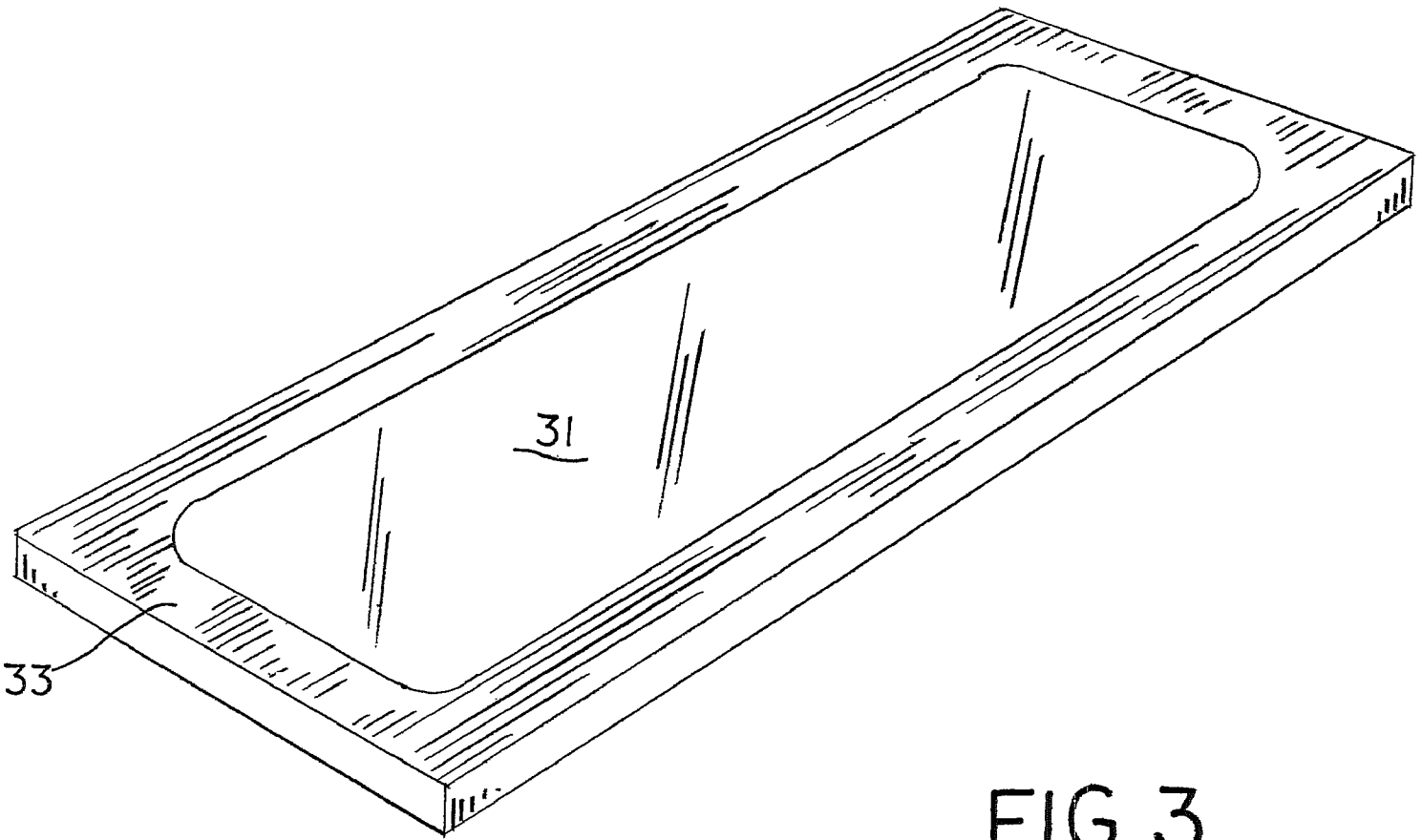
FIG. 3 is a perspective view of the collimator.

As further seen in FIG. 2 the window cover 10 includes a viewing window 20 that is mounted to a box 22. Window 20 is preferably of a plastic construction. An O-ring seal 23 is used around the perimeter of the viewing window 20 to prevent entry of water or sand into the box 22. Behind the viewing window 20 is an upper reflector 24. The upper reflector 24 is movable as shown in FIG. 3. The upper reflector 24 is above a lower reflector 26 which is stationary and has a mirrored reflective surface. The upper reflector 24 is in front of an armored upper armored plate 27 and the lower reflector is behind lower armored plate 16. The box 22 could be inverted as well. In that case, the upper reflector 24 would be movable and below the lower reflector 26 which would be fixed behind armored plate 16. The occupant 18 would initially view the lower reflector 26 which would be in the upper position. In the configuration shown in FIG. 2, the upper reflector 24 has reflective lower layer 28 which is preferably a polymer mirror or a polished metal mirror surface that is attached to a substrate 30. The substrate 30 is preferably made of aluminum honeycomb, lightweight foam, or plastic material that adds structural integrity to the top layer 28 of the upper reflector 24. A light filter 31 is placed between the upper and lower reflectors 24, 26.

An occupant 18 of the military vehicle 12 can change his field of view by pivoting the upper reflector 24. This may be done with a crank 32 attached to a worm gear assembly 34 as shown in FIG. 3. Pivoting the upper reflector 24 may also be accomplished by alternative means such as hydraulics, pneumatics, or cables. The light reflected from the upper reflector 24 to the lower reflector 26 passes through the filter 31. The filter 31 is made of a light filtering material which filters out portions of the light that may be harmful to the eyes of an occupant 18 of the vehicle. Another function of the filter 31 is to collimate light reaching the lower reflector to prevent the occupant from seeing extraneous objects. Extraneous objects are things which the occupant 18 would see when looking into the window cover that are not outside the vehicle itself. Examples of extraneous objects are parts of the inside of the sealed box 22, or mounting hardware for the upper mirror. The collimating function of the filter 31 ensures that the light reaching the occupant's eyes is only that reflected from the upper reflector 24 as opposed to light reflected from objects within the window cover 10, which would be distracting to an occupant. This provides a field of view to the occupant that approximates what he would see if looking through a traditional window. The collimation function of the filter 31 is achieved by painting the perimeter of the filter 31 with an opaque color that blocks all light in the painted area 33, which is shown in FIG. 3. Light may also be blocked by adding a layer of opaque material such as sheet metal over the filter to block light in what is shown as the painted area 33.

During use an occupant 18 looks through window 14 as would be done in the absence of the window cover 10 of this invention. Light that enters the viewing window 20 is reflected downward from the upper reflector 24 to the lower reflector 26 and then on to the occupant's 18 eyes. When the occupant 18 wishes to change the view he can see, he may change the position of the upper reflector 24 by using the crank 32. An external mirror 29 is placed above the viewing window 20 which will enhance the range of view available to the occupant 18 by allowing him to see objects close to the vehicle 12. Window 14 is bulletproof glass. Since the window 14 is behind armor projectiles 15 will not strike it. Projectiles 15 fired at the vehicle 12 can pierce the viewing window 20 and continue through the upper reflector 24 as shown in FIG. 2. The projectiles 15 will then strike the upper armored plate 27. The projectiles will leave holes in the upper reflector 24 that are the size of the projectile 15. This will allow a number of projectiles 15 to strike the viewing window 20 and the upper reflector 24 without obstructing the occupant's 18 view.

The detailed description related herein is meant only to exemplify the preferred embodiment of the invention to enable those skilled in the art to make and use it. The subject invention is not to be limited to the details given above for the preferred embodiment, but may be modified within the scope of the impending claims.

What is claimed is:

1. A window cover for covering a window of a vehicle, said cover comprising:

an upper armored plate having a top side, an underside, a forward end, and a rearward end, said forward end of said upper armored plate being farther from said window and said rearward end of said upper armored plate being nearer said window relative to said rearward end of said upper armored plate, said forward end of said upper armored plate being higher than said rearward end of said upper armored plate with the underside of said upper armored plate at least partially extending beyond an upper edge of said window relative to said forward end of said upper armored plate;

an upper reflector beneath said underside of said upper armored plate and movable with respect to said window and said upper armored plate, said upper reflector having a forward end and a rearward end, said forward end of said upper reflector being farther from said window relative to said rearward end of said upper reflector and said rearward end of said upper reflector being nearer said window relative to said forward end of said upper reflector, said forward end of said upper reflector being higher than said rearward end of said upper reflector;

a lower armored plate spaced below said upper armored plate, positioned in front of said window and at least partially below said upper reflector, said upper reflector being penetrable by a projectile fired from in front of said vehicle toward said window, said lower armored plate constituting means for stopping or deflecting a projectile;

a lower reflector having a forward end and a rearward end, said forward end of said lower reflector being farther from said window relative to said rearward end of said lower reflector and said rearward end of said lower reflector being nearer said window relative to said forward end of said lower reflector, said forward end of said lower reflector being higher than said rearward end of said lower reflector, said lower reflector being positioned beneath said upper reflector and behind said lower armored plate so that light reflected from said upper reflector strikes said lower reflector, said forward end of said lower reflector being lower than said rearward end of said upper reflector, whereby moving said upper reflector alters a view of objects outside of said vehicle as seen by an occupant of said vehicle.

2. A window cover as claimed in claim 1, wherein said upper reflector is spaced from said upper armored plate and movable with respect to said upper armored plate.

3. A window cover as claimed in claim 2, wherein said upper reflector is pivotable.

4. A window cover as claimed in claim 3, wherein said lower reflector is fixed with respect to said window and said upper and lower reflectors are substantially planar.

5. A window cover as claimed in claim 1, including a third reflector positioned above the lower reflector and in front of the upper reflector to allow a view other than that provided by only the upper reflector.

6. A window cover as claimed in claim 1, including a filter for filtering out a portion of light reflected from said upper reflector onto said lower reflector.

7. A window cover as claimed in claim 6, wherein said filter includes a collimator.

8. A window cover for covering a window and providing a view of objects outside of a vehicle to an occupant of said vehicle, said window cover comprising:

an upper armored plate having a top side and an underside at least partially extending beyond an upper edge of said window;

a lower armored plate in front of said window;

a lower reflector between said lower armored plate and said window, said lower reflector having a forward end, and a rearward end, said forward end of said lower reflector being farther from said window relative to said rearward end of said lower reflector and said rearward end of said lower reflector being nearer said window relative to said forward end of said lower reflector, said forward end of said lower reflector being higher than said rearward end of said lower reflector;

an upper reflector penetrable by a projectile and at least partially above said lower reflector and partially above said upper edge of window, said upper reflector having a forward end, and a rearward end, said forward end of said upper reflector being farther from said window relative to said rearward end of said upper reflector and said rearward end of said upper reflector being nearer said window relative to said forward end of said upper reflector, said forward end of said upper reflector being higher than said rearward end of said upper reflector, so that light reflected from said upper reflector strikes said lower reflector, said rearward end of said upper reflector being higher than said forward end of said lower reflector, said upper reflector being movable relative to said lower reflector and said upper armored plate, whereby the view, as seen by said occupant, is altered by moving said upper reflector.

9. A window cover as claimed in claim 8, wherein said upper reflector is pivotable with respect to said upper armored plate.

10. A window cover as claimed in claim 9, wherein said upper and lower reflectors are substantially planar having a single reflective surface.

* * * * *